313-414 SR
4/15/86 OR 4,583,024

United States Patent [19]
Chen

[11] Patent Number: 4,583,024
[45] Date of Patent: Apr. 15, 1986

[54] COLOR PICTURE TUBE HAVING AN INLINE ELECTRON GUN WITH BUILT-IN STIGMATOR

[75] Inventor: Hsing-Yao Chen, Landisville, Pa.

[73] Assignee: RCA Corporation, Princeton, N.J.

[21] Appl. No.: 581,668

[22] Filed: Feb. 21, 1984

[51] Int. Cl.[4] ..... H01J 29/56; H01J 29/51
[52] U.S. Cl. ..... 313/414; 313/460
[58] Field of Search ..... 313/409, 412, 413, 414, 313/449, 458, 460

[56] References Cited

U.S. PATENT DOCUMENTS

| | | | |
|---|---|---|---|
| 2,884,559 | 4/1959 | Cooper et al. | 315/14 |
| 3,873,879 | 3/1975 | Hughes | 315/13 C |
| 3,949,262 | 4/1976 | Ohkoshi et al. | 313/412 |
| 4,275,332 | 6/1981 | Ashizaki et al. | 313/409 X |
| 4,317,065 | 2/1982 | Hughes | 313/409 X |
| 4,362,964 | 12/1982 | Sakurai et al. | 313/414 |
| 4,366,419 | 12/1982 | Barten | 315/382 |
| 4,370,592 | 1/1983 | Hughes et al. | 313/414 |
| 4,374,342 | 2/1983 | Say | 313/414 |
| 4,388,553 | 6/1983 | Chen | 313/414 |
| 4,406,970 | 9/1983 | Hughes | 313/414 |

FOREIGN PATENT DOCUMENTS 2112564 7/1983 United Kingdom .

*Primary Examiner*—Palmer C. DeMeo
*Assistant Examiner*—Sandra L. O'Shea
*Attorney, Agent, or Firm*—Eugene M. Whitacre; Dennis H. Irlbeck

[57] ABSTRACT

An improved color picture tube has an inline electron gun for generating and directing three electron beams, a center beam and two side beams, along coplanar paths toward a screen of the tube. The gun includes a main focus lens for focusing the electron beams. The main focus lens is formed by two spaced electrode members, each having three separate inline apertures therein, a center aperture and two side apertures. The improvement comprises each of the apertures in each of the focus lens electrodes having a shape that distorts a portion of the focus lens thereat, to at least partially compensate for an astigmatic effect within the tube that acts on an associated electron beam. The side apertures in both of the electrodes are nonsymmetrical about axes that pass through the respective side apertures and are perpendicular to the initial coplanar paths of the electron beams.

4 Claims, 5 Drawing Figures

Fig. 1
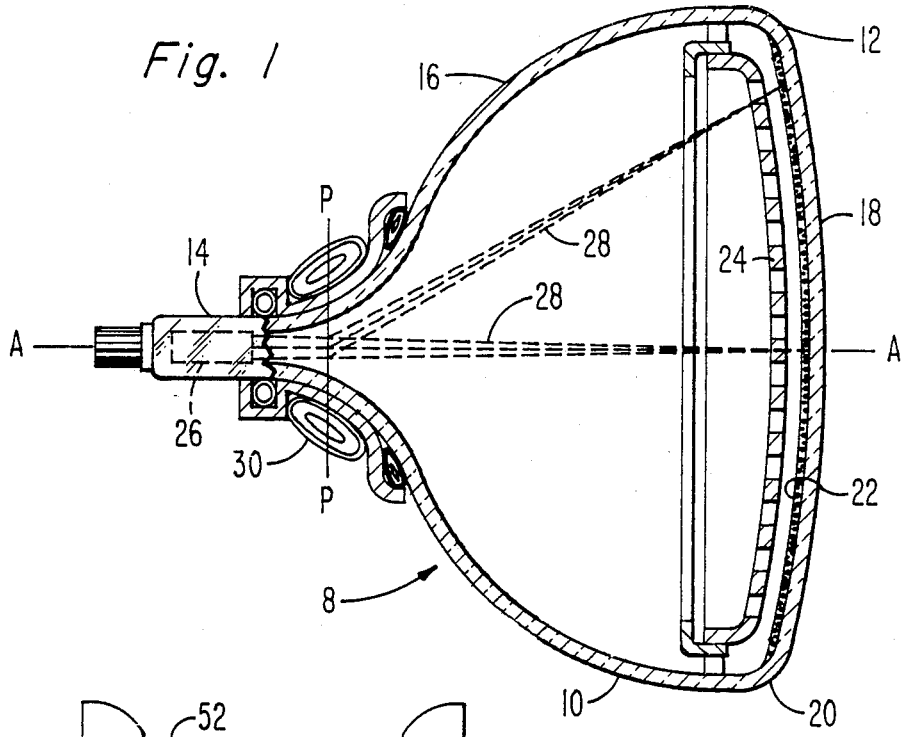
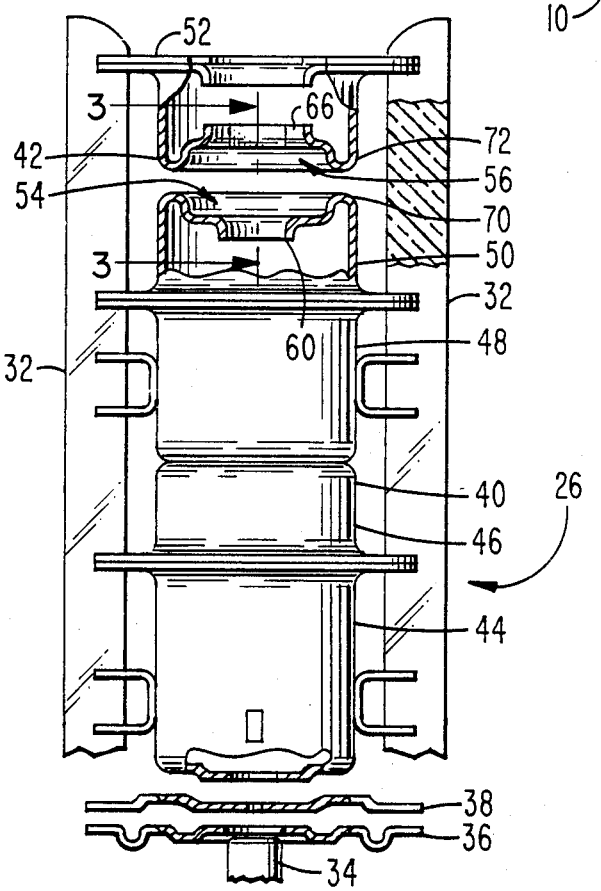
Fig. 2

COLOR PICTURE TUBE HAVING AN INLINE ELECTRON GUN WITH BUILT-IN STIGMATOR

BACKGROUND OF THE INVENTION

The present invention relates to color picture tubes having improved inline electron guns, and particularly to an improvement in such guns for correcting astigmatism formed by a focus lens or for balancing an overfocusing caused by a deflection yoke.

An inline electron gun is one designed to generate or initiate preferably three electron beams in a common plane and direct those beams along convergent paths to a point or small area of convergence near the tube screen. In one type of inline electron gun, shown in U.S. Pat. No. 3,873,879, issued to R. H. Hughes on Mar. 25, 1975, the main electrostatic focusing lenses for focusing the electron beams are formed between two electrodes referred to as the first and second accelerating and focusing electrodes. These electrodes include two cup-shaped members havng bottoms facing each other. Three apertures are included in each cup bottom to permit passage of three electron beams and to form three separate main focus lenses, one for each electron beam. In a preferred embodiment, the overall diameter of the electron gun is such that the gun will fit into a 29 mm tube neck. Because of this size requirement, the three focusing lenses are very closely spaced from each other, thereby providing a severe limitation on focus lens design. It is known in the art that the larger the focus lens diameter, the less will be the spherical aberration which restricts the focus quality.

In addition to the focus lens diameter, the spacing between focus lens electrode surfaces is important, because greater spacing provides a more gentle voltage gradient in the lens, which also reduces spherical aberration. Unfortunately, greater spacing between electrodes beyond a particular limit (typically 1.27 mm) generally is not permissible because of beam bending from electrostatic charges on the neck glass penetrating into the space between the electrodes, which causes electron beam misconvergence.

In U.S. Pat. No. 4,370,592, issued to R. H. Hughes and B. G. Marks on Jan. 25, 1983, an electron gun is described wherein the main focus lens is formed by two spaced electrodes. Each electrode includes a plurality of apertures therein, equal to the number of electron beams, and also a peripheral rim, with the peripheral rims of the two electrodes facing each other. The apertured portion of each electrode is located within a recess set back from the rim. The effect of this main focus lens is to provide the gentle voltage gradient sought to reduce spherical aberration. However, the main focus lens causes a slot effect astigmatism that is corrected in the electron gun by the addition of a horizontal slot opening at the exit of the second focus and accelerating electrode. This slot is formed by two parallel strips, which provide a similar effect on all three electron beams.

An improvement in the design of such a slot is disclosed in U.S. Pat. No. 4,388,553, issued to H.-Y. Chen on June 14, 1983. In this patent, the ends of two parallel strips that form the slot are tailored to create a weaker stigmator effect on the two side beams than on the center beam.

Although these prior art stigmator slots have proven very effective in correcting astigmatism, they still require the two strips, i.e., additional parts, as well as extra labor for their attachment to the electron gun. Therefore, there is a need for other means for correcting astigmatism which do not require additional parts and the associated labor required to attach those parts to an electron gun.

SUMMARY OF THE INVENTION

An improved color picture tube has an inline electron gun for generating and directing three electron beams, a center beam and two side beams, along coplanar paths toward a screen of the tube. The gun includes a main focus lens for focusing the electron beams. The main focus lens is formed by two spaced electrode members, each having three separate inline apertures therein, a center aperture and two side apertures. The improvement comprises each of the apertures in each of the focus lens electrodes having a shape that distorts a portion of the focus lens thereat, to at least partially compensate for an astigmatic effect within the tube that acts on an associated electron beam. The side apertures in both of the electrodes are nonsymmetrical about axes that pass through the respective side apertures and are perpendicular to the initial coplanar paths of the electron beams.

BRIEF DESCRIPTION OF THE DRAWINGS

FIG. 1 is a plan view, partly in axial section, of a shadow mask color picture tube embodying the invention.

FIG. 2 is a partial axial section view of the electron gun shown in dashed lines in FIG. 1.

DETAILED DESCRIPTION OF THE PREFERRED EMBODIMENT

Figure 3:
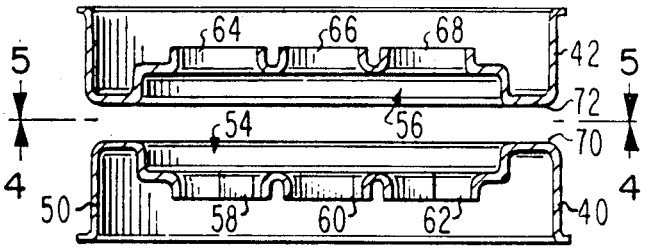
FIG. 3 is an axial sectional view of the G3 and G4 electrodes of the electron gun of FIG. 2.

FIG. 1 is a plan view of a rectangular color picture tube 8 having a glass envelope 10 comprising a rectangular faceplate cap or panel 12 and a tubular neck 14 connected by a funnel 16. The panel 12 comprises a viewing faceplate 18 and a peripheral flange or sidewall 20 which is sealed to the funnel 16. A three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multiapertured color selection electrode or shadow mask 24 is removably mounted, by conventional means, in predetermined spaced relation to the screen 22. An improved inline electron gun 26, shown schematically by dashed lines in FIG. 1, is centrally mounted within the neck 14 to generate and direct three electron beams 28 along coplanar convergent paths through the mask 24 to the screen 22.

The tube 8 in FIG. 1 is designed to be used with an external magnetic deflection yoke, such as the yoke 30 schematically shown surrounding the neck 14 and funnel 16 in the neighborhood of their junction. When activated, the yoke 30 subjects the three beams 28 to magnetic fields which cause the beams to scan horizontally and vertically in a rectangular raster over the screen 22. The initial plane of deflection (at zero deflection) is shown by the line P-P in FIG. 1 at about the middle of the yoke 30. Because of fringe fields, the zone of deflection of the tube extends axially, from the yoke 30 into the region of the gun 26. For simplicity, the actual curvature of the deflected beam paths in the deflection zone is not shown in FIG. 1.

The details of the electron gun 26 are shown in FIGS. 2 through 5. The gun comprises two glass support rods or beads 32 on which the various electrodes are mounted. These electrodes include three equally spaced coplanar cathodes 34 (one for each beam), a control grid electrode 36 (G1), a screen grid electrode 38 (G2), a first focusing electrode 40 (G3), and a second focusing electrode 42 (G4), spaced along the glass rods 32 in the order named. Each of the G1 through G4 electrodes has three inline apertures therein to permit passage of three coplanar electron beams. The main electrostatic focusing lens in the gun 26 is formed between the G3 electrode 40 and the G4 electrode 42. The G3 electrode 40 is formed with four cup-shaped elements 44, 46, 48 and 50. The open ends of two of these elements, 44 and 46, are attached to each other, and the open ends of the other two elements, 48 and 50, are also attached to each other. The closed end of the third element 48 is attached to the closed end of the second element 46. Although the G3 electrode 40 is shown as a four-piece structure, it could be fabricated from any number of elements. The G4 electrode 42 also is cup-shaped but has its open end closed with an apertured plate 52.

The facing closed ends of the G3 electrode 40 and the G4 electrode 42 have large recesses 54 and 56, respectively, therein. The recesses 54 and 56 set back the portion of the closed end of the G3 electrode 40 that contains three apertures, 58, 60 and 62, from the portion of the closed end of the G4 electrode 42 that contains three apertures, 64, 66 and 68. The remaining portions of the closed ends of the G3 electrode 40 and the G4 electrode 42 form rims 70 and 72, respectively, that extend peripherally around the recesses 54 and 56. The rims 70 and 72 are the closest portions of the two electrodes 40 and 42.

The electron gun 26 of FIG. 2 provides a main focusing lens having substantially reduced spherical aberration compared to that of most prior guns. The reduction in spherical aberration is caused by an increase in the size of the main focus lens. This increase in lens size results from recessing the electrode apertures. In most prior inline guns, the strongest equipotential lines of the electrostatic field are concentrated at each opposing pairs of apertures. However, in the gun 26 of FIG. 2, the strongest equipotential lines extend continuously between the rims 70 and 72, so that the predominant portion of the main focus lens appears to be a single large lens extending through the three electron beam paths. The remaining portion of the main focus lens is formed by weaker equipotential lines located at the apertures in the electrodes. The performance and advantages of an electron gun similar to the electron gun 26 are discussed in the above-cited U.S. Pat. No. 4,370,592.

There is an astigmatism, i.e., asymmetric effect, formed by the main focusing lens as a result of penetration of the focusing field through the open areas of the recesses. This effect is caused by the greater compression of equipotential lines at the sides of the focus lens than at the two areas near the center of the focus lens. The field penetration causes the main focus lens to have greater vertical lens strength than horizontal lens strength. A correction is made for this astigmatism in the electron gun 26 of FIG. 2 by shaping each of the apertures 58, 60 and 62 in the G3 electrode 40 and each of the apertures 64, 66 and 68 in the G4 electrode 42 to distort a portion of the focus field thereat. Such shaping and resultant distortion are such as to at least partially compensate for the astigmatism of the electron gun. Furthermore, since there also is an astigmatic effect caused by many deflection yokes, the aperture shaping can be such as to also at least partially compensate for the yoke astigmatism.

Figure 4:
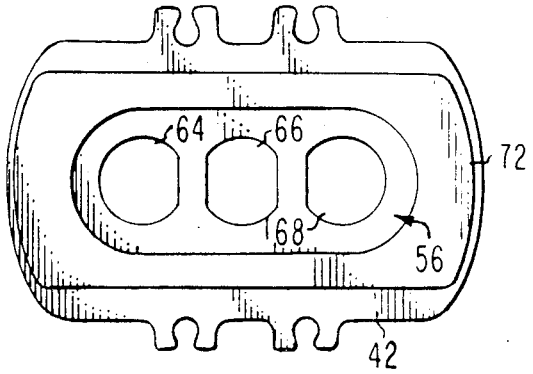
FIG. 4 is a front view of an electrode of the electron gun of FIG. 2 taken along line 4—4 of FIG. 3.
Figure 5:
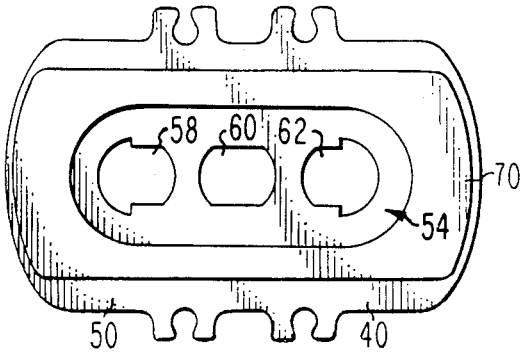
FIG. 5 is a front view of another electrode of the electron gun of FIG. 2 taken along line 5—5 of FIG. 3.

FIGS. 3, 4 and 5 show the details of the G3 and G4 focus electrodes 40 and 42, respectively, and of the apertures therein. The apertures 64, 66 and 68 of the G4 electrode 42 are shown in FIG. 4. The periphery of the center aperture 66 is generally circular with two straight sides facing the side apertures 64 and 68. The center aperture 66 is symmetrical about an axis that passes through its center and is perpendicular to the initial coplanar paths of the electron beams. The peripheries of the side apertures 64 and 68 also are generally circular, but each has a single straight side facing the center aperture 66. The side apertures 64 and 68 are nonsymmmetrical about axes that pass through the centers of the respective apertures and are perpendicular to the initial coplanar paths of the electron beams.

The apertures 58, 60 and 62 of the G3 electrode 40 are shown in FIG. 5. The periphery of the center aperture 60 is generally circular with two opposite straight sides which extend parallel to the inline direction of the inline apertures. The center aperture 60 is symmetrical about an axis that passes through its center and is perpendicular to the initial coplanar paths of the electon beams. The peripheries of the side apertures 58 and 62 are generally circular, but with each having two indented portions in the sides facing the center aperture 60, which narrow the inside facing portions of the side apertures 58 and 62 in a direction perpendicular to the inline direction of the inline apertures. The side apertures 58 and 62 are nonsymmetrical about axes that pass through the centers of the respective apertures and are perpendicular to the initial coplanar paths of the electron beams.

Although each pair of the corresponding facing apertures in the G3 and G4 electrodes is of substantially different shape, each aperture of the pair provides a similar astigmatic correction. This is because different shapes are required in different portions of the focus field to obtain the same effect. For example, the center aperture 60 in the G3 electrode 40, which is in the converging portion of the main focus lens, is vertically narrowed and horizontally elongated, and the center aperture 66 in the G4 electrode 42, which is in the diverging portion of the main focus lens, is vertically elongated and horizontally narrowed. Therefore, an electron beam first passing through the center aperture 60 in the G3 electrode 40 will be subject to greater vertical convergence than horizontal convergence, and then to less vertical divergence than horizontal divergence when it passes through the center aperture 66 of the G4 electrode 42. Similar effects will be experienced by the side beams as they pass through the side apertures, except that only the inward portions of the side electron beams will be affected because of the vertically asymmetrical shape of the side apertures.

Although the present invention has been described with respect to a compensation for astigmatism in tubes having expanded focus lens, it should be understood that the present invention may be applied to tubes having other types of inline electron guns wherein some other type of compensation is needed. For example, the invention may be applied to an electron gun having a symmetrical main focus lens to create an effect within the electron gun to balance overfocusing caused by some types of deflection yokes.

What is claimed is:

1. In a color picture tube having an inline electron gun for generating and directing three electron beams, a center beam and two side beams, along initial coplanar paths toward a screen of said tube, said gun including a main focus lens for focusing said electron beams, the main focus lens being formed by two spaced electrodes each having three separate inline apertures therein, a center aperture and two side apertures, each focus lens electrode also including a peripheral rim, the peripheral rims of the two electrodes facing each other, and the apertured portion of each electrode being within a recess set back from the rim, the improvement comprising each of the apertures in each of said focus lens electrodes having a shape that distorts a portion of the focus lens thereat to at least partially compensate for an astigmatic effect within said tube that acts on an associated electron beam, the side apertures in both of said electrodes being nonsymmetrical about axes that pass through the centers of the respective side apertures and are perpendicular to the initial coplanar paths of the electron beams, the apertures in one of the focus lens electrodes being of different shapes than the corresponding facing apertures in the other focus lens electrode, and the shapes of the apertures in one of the focus lens electrodes providing a similar compensation on the respective electron beams in a converging portion of the main focus lens that is provided by the different aperture shapes of the other focus lens electrode in a diverging portion of the main focus lens.

2. The tube as defined in claim 1, wherein the center apertures in both of said electrodes are symmetrical about axes that pass through the respective center apertures and are perpendicular to the initial coplanar paths of the electron beams.

3. The tube as defined in claim 2, wherein the periphery of the center aperture of a first of said electrodes is generally circular with two straight sides facing the side apertures therein, and the periphery of the side apertures in said first of said electrodes are generally circular with each having a straight side facing the center aperture therein.

4. The tube as defined in claim 3, wherein the periphery of the center aperture of a second of said electrodes is generally circular with two opposite straight sides, each extending parallel to the inline direction of the inline apertures, and the peripheries of the side apertures in said second of said electrodes are generally circular, each with two indented portions in the sides of the side apertures facing the center aperture which narrow the inside facing portions of the side apertures in a direction perpendicular to the inline direction of the inline apertures.

* * * * *